US006085680A

United States Patent [19]

Samuelsen

[11] Patent Number: 6,085,680

[45] Date of Patent: Jul. 11, 2000

[54] DEVICE FOR INCREASING THE STEERING EFFECT OF A RUDDER

[75] Inventor: Arild K. Samuelsen, Tananger, Norway

[73] Assignee: Den Norske Stats Oljeselskap A.S., Stavanger, Norway

[21] Appl. No.: 09/381,684

[22] PCT Filed: Mar. 19, 1998

[86] PCT No.: PCT/NO98/00087

§ 371 Date: Sep. 23, 1999

§ 102(e) Date: Sep. 23, 1999

[87] PCT Pub. No.: WO98/42565

PCT Pub. Date: Oct. 1, 1998

[30] Foreign Application Priority Data

Mar. 24, 1997 [NO] Norway ..... 971368

[51] Int. Cl.[7] ..... B63H 25/06

[52] U.S. Cl. ..... 114/162; 244/207

[58] Field of Search ..... 114/162, 163, 114/164, 144 R; 244/207, 208

[56] References Cited

U.S. PATENT DOCUMENTS 3,680,511 8/1972 English ..... 114/162
4,342,275 8/1982 Brix et al. ..... 114/162
4,515,101 5/1985 Akerblom ..... 114/162

FOREIGN PATENT DOCUMENTS 160.126 8/1986 Norway .
1 309 387 9/1970 United Kingdom .

OTHER PUBLICATIONS

Patent Abstracts of Japan, Atsushi et al., "Rudder", JP 57 110597, (Jul. 9, 1982).
Patent Abstracts of Japan, Atsushi et al., "Rudder", JP 57 110598, (Jul. 9, 1982).
Patent Abstracts of Japan, Atsushi et al., "Rudder Beam", JP 57 121998, (Jul. 29, 1982).

*Primary Examiner*—Jesus D. Sotelo
*Attorney, Agent, or Firm*—Foley & Lardner

[57] ABSTRACT

An apparatus for enhancing the steering effect of ship rudders comprising a rudder with at least one passageway for supplying seawater to ducts in the rudder, and a profile element extending substantially vertically at a leading edge of the rudder and being pivotable about a generally vertical axis, wherein distribution ducts formed between the profile element and the rudder communicate with the passageway and are adjustable so that relative movement of the profile element and the rudder causes seawater to be discharged along the rudder surface facing abaft.

22 Claims, 6 Drawing Sheets

DEVICE FOR INCREASING THE STEERING EFFECT OF A RUDDER

BACKGROUND OF THE INVENTION

1. Field of the Invention

This invention relates to an arrangement for enhancing the steering effect of ships' rudders, comprising at least one passageway for supplying seawater from a pump to ducts in the rudder, and means communicating with the ducts and being adapted to discharge seawater supplied through them, at the rudder surface.

2. Description of the Related Art

Previously there are known many forms of steering effect enhancing means or elements in connection with ships' rudders. In particular at relatively low speeds such enhanced steering effect can be very useful when manoeuvring a ship.

A known form of such means are flaps or fins being hinged or pivotable in relation to the main part of the rudder, in particular being located at the trailing edge thereof. An example of such a design is to be found in Norwegian Patent 160.126.

Another form of auxiliary means are ports or nozzles in or at the rudder surface and being adapted to discharge water flows that can contribute to enhancing the steering effect of the rudder. Examples of such designs can be found in British patent 1.309.387 and Japanese patent publications Nos. 57.110.597, 57.110.598 and 57.121.998. These various designs are in part based on the supply of seawater to the rudder and its discharge openings or nozzles, through the actual rudder stock. However, there are also described designs where the seawater inlet and the transfer to the ports or openings takes place in a passive manner, i.e. without the influence of any pump which can impart energy to the seawater flow in the form of an increase pressure or velocity.

SUMMARY OF THE INVENTION

The present invention is directed to an arrangement for such enhanced steering effect of ship rudders, with an improved efficiency and in part a simplification of the arrangement compared to the previously known designs. In this connection it is a substantial point in the basic solution according to the invention, that there is produced an additional lift as a result of extra water flow supply over substantially the whole of one rudder side or rudder surface when the rudder is deflected at an angle so as to manoeuvre the ship to the starboard or port side. It is essential in this connection that such increased lift is generated at the rudder surface facing abaft with the rudder deflection concerned, for the desired turning movement of the ship.

Closer statements of the novel and specific features of the arrangement according to the invention, are found in the claims.

An apparatus according to the invention comprises a rudder with at least one passageway for supplying seawater to ducts in the rudder, and a profile element extending substantially vertically at a leading edge of the rudder and being pivotable about a generally vertical axis, wherein distribution ducts formed between the profile element and the rudder communicate with the passageway and are adjustable so that relative movement of the profile element and the rudder causes seawater to be discharged along the rudder surface facing abaft.

The apparatus may further comprise a turning mechanism associated with a rudder stock, wherein the profile element is angularly adjustable about the vertical axis by the turning mechanism, the turning mechanism comprising at least one manoeuvre rod, one end of which is directly or indirectly articulated to the profile element.

The profile element may comprise internal connection ducts which form a central duct that leads out to either side of the profile element for discharging seawater adjacent to outer portions of the profile element and distributes seawater to either one or the other side depending upon an angular position of the profile element with respect to the vertical axis.

The apparatus may further comprise a control valve for controlling distribution of seawater to either one or the other side of the profile element, the control valve comprising first and second tubular elements, the tubular elements being concentric about the vertical axis, the first element being rotationally connected to the rudder, the second element being rotationally connected to the profile element, and both elements having respective pairs of cooperating, axially extending slot openings forming substantially open and substantially closed flow openings depending upon the angular position of the profile element, whereby each of the slot openings in the second tubular element communicates with a separate one of the distribution ducts.

A space between the leading edge of the rudder and the inside of the profile element may constitute the distribution ducts.

The apparatus may further comprise a nozzle with an adjustable angle provided at a trailing edge of the rudder and adapted to discharge seawater supplied through an associated duct, through the rudder. The nozzle may be incorporated in a rear, pivotable rudder fin.

The passageway may have, in part, the form of an annular space surrounding a rudder stock and a swivel device may be provided for a rotational connection between a ship hull and the rudder.

The annular space may be subdivided into two passages, of which one communicates with a duct leading to the nozzle, and the other communicates with a duct leading to the profile element.

The passageway may extend in part internally in a rudder stock and a distribution valve for supplying water to the profile element and the nozzle, may be arranged axially in the extension of the rudder stock.

The distribution valve may comprise a rotatable valve body which, depending upon its rotational position, is adapted to substantially block at least one of two valve openings that communicate with a duct to the nozzle on one hand, and the distribution ducts of the profile element on the other hand.

In the following description the invention will be explained more closely with reference to the drawings, whereby also various specific features and advantages will appear from the description with reference to the drawings.

DETAILED DESCRIPTION OF THE PREFERRED EMBODIMENT

Figure 1:
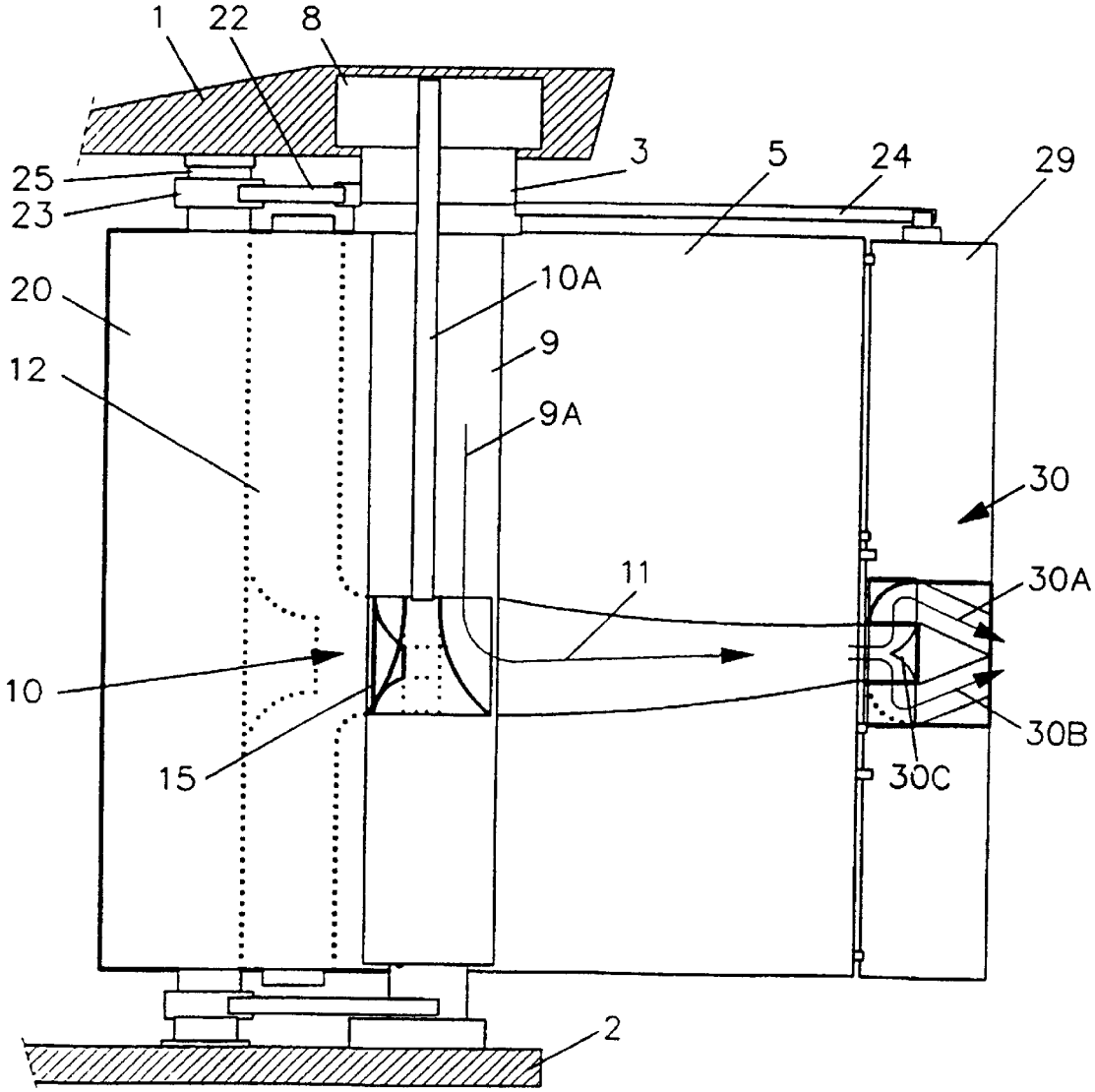
FIG. 1 in elevation and partial section shows a first embodiment of the rudder arrangement according to the invention.
Figure 2:
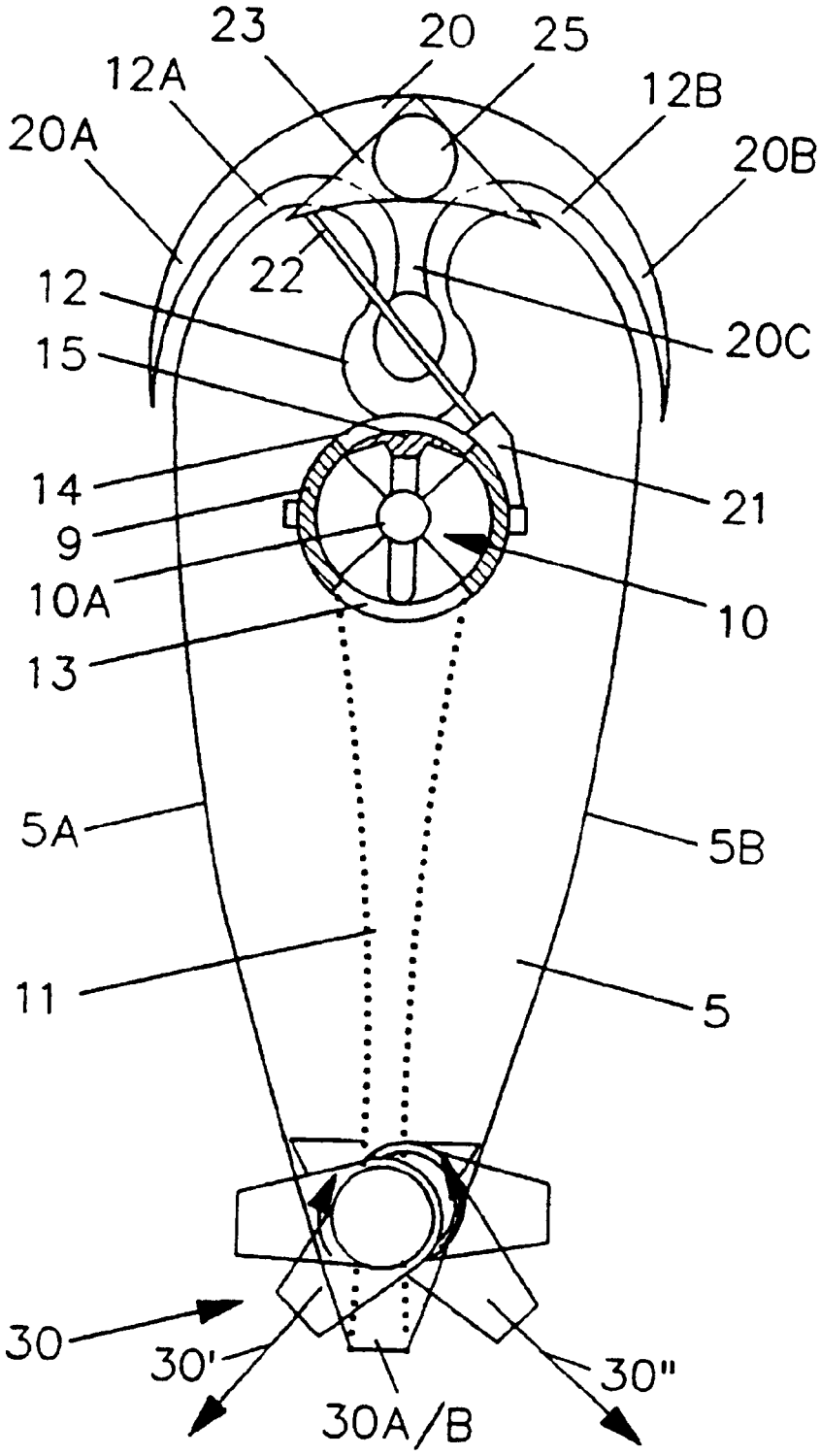
FIG. 2 shows the arrangement of FIG. 1 from above and in partial cross section, FIG. 3 in cross section shows a distribution valve incorporated in the embodiment of FIGS. 1 and 2.
Figure 4:
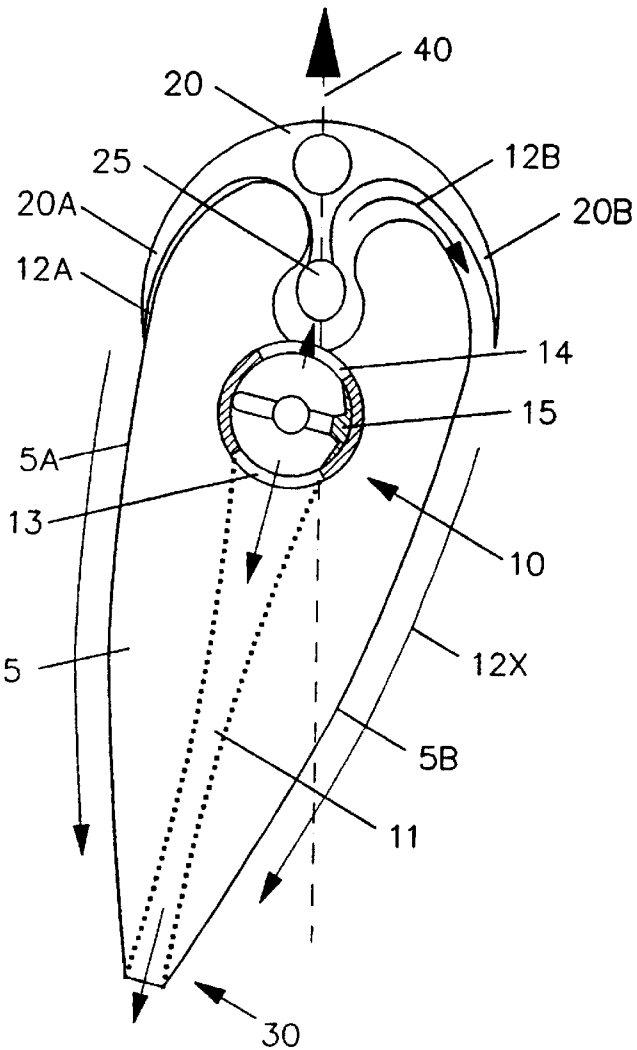
FIG. 4 shows a somewhat modified embodiment corresponding to FIG. 2, with the rudder in a deflected position, FIG. 5 in elevation shows a rudder arrangement according to another embodiment.

In FIGS. 1, 2 and 4 the actual rudder is denoted 5 and this has an associated rudder stock 9. In FIG. 1 there are shown one part 1 and another part 2 belonging to the actual ship structure, and in a common way serving for the journalling of the rudder. FIG. 1 shows a trailing turnable rudder fin 29 which in principle can be of a design known per se. Two forms of auxiliary means for enhancing the steering effect are incorporated in the design of FIGS. 1, 2 and 3. Of primary interest in the present context is a leading edge profile or profile element 20 extending generally vertically along the whole leading edge of rudder 5. Profile element 20 is pivotable about an axis as shown at 25 in these figures of drawings; FIG. 2 shows profile element 20 in a neutral, central position, and FIG. 4 shows the element in a deflected angular position in relation to the rest of rudder 5. As will be explained more closely below, this is related to an angular deflection of the actual rudder 5 in FIG. 4 in relation to the centerline of the ship, as indicated at 40 in FIG. 4.

In addition to profile element 20 at the leading edge of rudder 5, there are also provided nozzles as shown at 30, for discharging seawater flows that can additionally serve to assist in increasing the steering effect of the rudder. At this point it is to be noted that nozzle 30 in FIGS. 1 and 2 is shown to be pivotable, whereas in the modified embodiment of FIG. 4 there is a fixed nozzle 30 directing the water flow straightly backwards from rudder 5. Such fixed are previously known from the patent specifications referred to above. However, the pivotable nozzles 30 in FIGS. 1 and 2 have a particular and advantageous combined effect together with profile element 20.

A pump (not shown) located in the ship itself, serves to furnish seawater at a pressure to rudder 5. For this purpose the rudder stock 9 has an internal passageway 9A communicating with a chamber B through a swivel device 3, so that seawater can be transferred from the pump in the ship to rudder 5. In the rudder there are provided ducts as shown at 11 and 12 for the further conveying of seawater to nozzle 30 and to the region at profile element 20, respectively.

In order to distribute the seawater supply from above through passageway 9A in rudder stock 9, there is provided a valve 10 that makes it possible to adjust the proportion of seawater supply to duct 11 and duct 12; a rotatable valve body 15 in valve 10 being adapted to be set angularly by means of a spindle 10A extending up through passageway 9A and possibly into the ship hull 1 concerned.

Like FIG. 1, FIG. 2 shows a setting of distribution valve 10 so that valve body 15 blocks a forward valve opening 14, but opens for seawater out through a valve opening 13 to duct 11 for water supply to nozzle means 30. In FIG. 2 this is shown at various angular positions, of which two are indicated 30' and 30".

Figure 3:
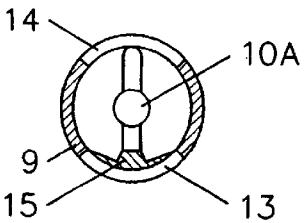

FIG. 3 shows another angular setting, i.e. with valve body 15 in front of opening 13 so that this opening is blocked. Accordingly seawater will exit through opening 14 and therefrom (see FIGS. 2 and 4) more or less directly out into a cavity or a portion of a distribution duct 12 being formed in the space between the leading edge of the actual rudder 5 and the inside of profile element 20. In this intermediate space therefor in the neutral position of the profile element as shown in FIG. 2, there will exist two laterally directed and slot-shaped distribution ducts 12A and 12B that communicate with the common cavity 12 centrally in the rudder and preferably closely associated with valve 10.

Finally FIG. 4 shows a position of valve body 15 making possible outflow of seawater through both openings 13 and 14, so that nozzle means 30 as well as profile element 20 with associated active distribution duct 12B, contribute to an enhanced steering effect.

Of essential importance, in a deflected position as shown in FIG. 4, is the extra seawater flow that is indicated at 12X and coming just from distribution duct 12B in the space between the leading edge of rudder 5 and profile element 20. This additional flow 12X gives a strongly increased lift at the adjacent rudder side, that substantially as a whole contributes to this desired effect. On the other hand at the opposite side, distribution duct 12A is essentially blocked since the end portion of lateral part 20A of profile element 20 engages the adjacent surface 5A of rudder 5. Thus, it is seen that distribution ducts 12A and 12B, at either side of the rudder, are adjustable in consequence of the angular adjustability of profile element 20.

As shown quite schematically in FIG. 2, profile element 20 can be adjusted angularly by means of a turning mechanism comprising e.g. a hydraulic cylinder 21 in association with rudder stock 9, a manoeuvre rod 22 and a turning lever 23 attached to the profile element, whereby the outer end of rod 22 preferably is articulated to arm 23. Rod 22 and arm 23 are also shown in FIG. 1. Moreover, FIG. 1 shows another rod 24 at the upper edge of rudder 5, for angular adjustment of rudder fin 29. Accordingly the angular movement of profile element 20 and fin 29 can be coordinated.

In this connection, it is an advantageous embodiment to build nozzle 30 and rudder fin 29 together, so that the nozzle will have an angular movement corresponding to the angular adjustment of fin 29. FIG. 2 illustrates various possible angular positions in that respect, whereby arrows 30' and 30" as already mentioned above, represent two angular positions of nozzle 30 and thereby rudder fin 29. In FIG. 2 there are also shown two nozzle positions laterally at right angles and besides a neutral position with nozzles (30A–B) straight rearwards. It is obvious that the coordination of the profile element's angular position and the nozzle direction is decisive for a combined optimal effect of these auxiliary means.

FIG. 1 also shows a particular design of nozzle 30, where the nozzle is subdivided into an upper nozzle outlet 30A and a lower nozzle outlet 30B, these converging here towards one another and with an intermediate splitting element 30C receiving the water flow from duct 11. At the junction from this at the trailing edge of the actual rudder 5, to fin 29 with nozzle 30, there must apparently be provided some form of swivel connection. Such swivels are known in various embodiments and will not be more closely described in this context.

The manoeuvring of a ship being provided with a rudder arrangement as described here, in the usual way, will be controlled from operating means or apparatus at the bridge of the ship, for example whereby control and steering systems based on electronics and/or hydraulics in a known manner can be utilized in a complete system. In this way there can be provided for steering or regulation of the required pump (e.g. ballast pump), distribution valve, angular setting of profile element and possibly flap or fin at the trailing edge of the rudder concerned.

The steering can be arranged so that e.g. upon a command from the bridge for a starboard turn of the ship, the profile element will remain at the same angle until the rudder deflection has attained e.g. 10°, which can correspond to a situation where the distribution duct at one side will be blocked and the whole water flow be directed to the port side of the rudder. Then there will be generated a reduced pressure at the port side of the rudder compared to the starboard side thereof and the rudder will be pushed in the port direction. Thus, the ship will turn starboard. Upon further angular movement of the rudder in the same direction, the profile element will maintain the same setting in relation to the rudder and will follow the turning movement thereof.

According to the embodiment of FIGS. 1 and 2, a seawater flow can at the same time be led rearwards through the duct in the rudder, whereby the splitting element 30C in nozzle 30 (FIG. 1) can also have a venturi effect that further increases the thruster force exerted by nozzle 30. The moveability of the output nozzles at the trailing edge of the rudder flap has particular interest at small rudder deflections, in particular thereby that the nozzle angle can be set at up to 90° in relation to the longitudinal axis of the rudder. Together with the rudder flap or fin the nozzles can be brought to have twice as large an angular deflection as the rudder itself.

Figure 5:
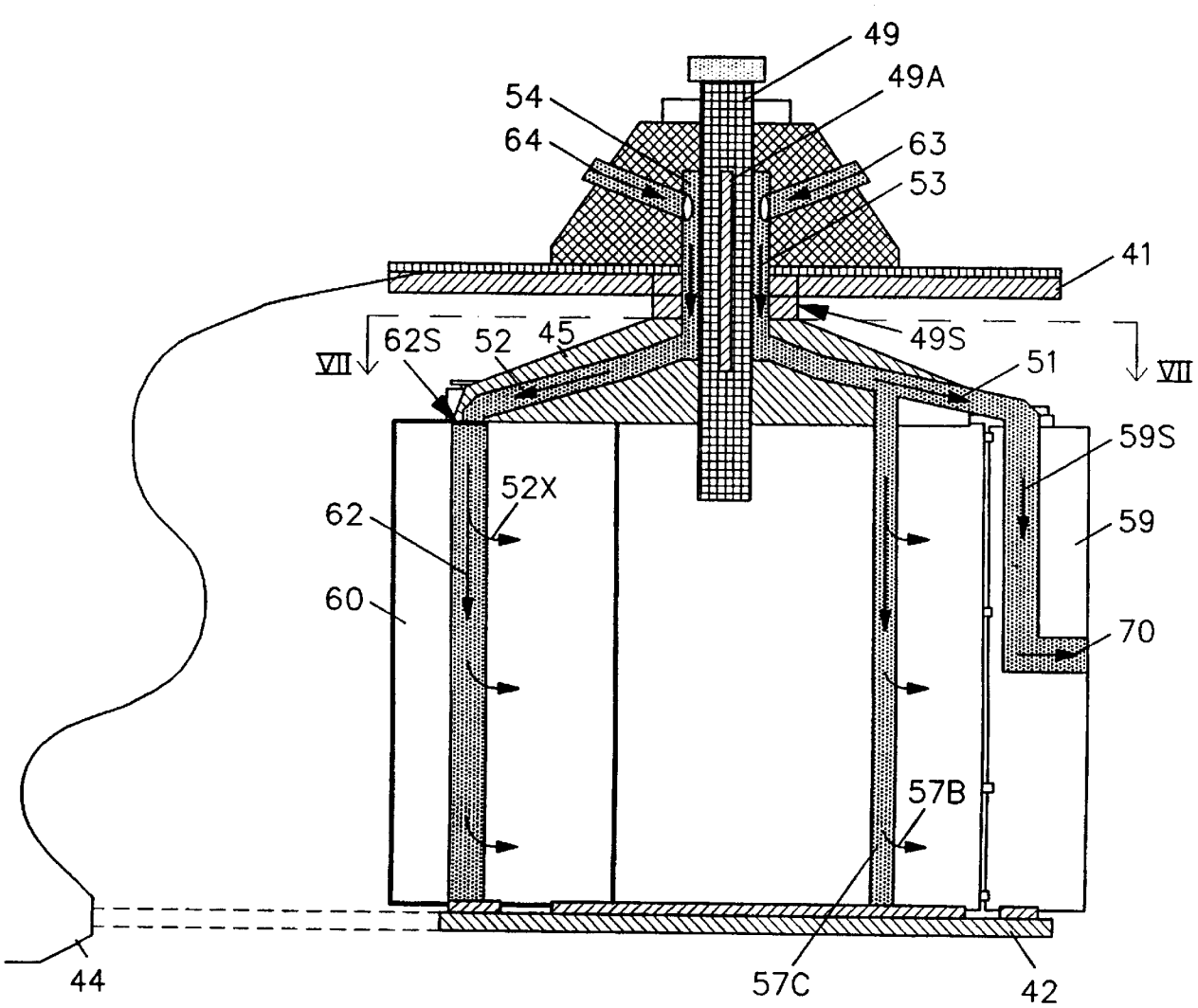

In the second embodiment of the invention, as illustrated in FIG. 5 and the subsequent figures of drawings, several of the same structural elements are incorporated as described above with reference to FIGS. 1–4. Thus, FIG. 5 shows parts 41 and 42 of the actual ship structure, that as such is also indicated at 44. At the trailing edge of rudder 45 there is mounted a pivotable rudder fin 59 and the rudder stock is shown at 49. At the leading edge of the rudder there is provided a profile element 60 that is preferably angularly adjustable, as is profile element 20 in the embodiment discussed above. A nozzle 70 is shown relatively schematically as an integrated part of the rudder fin 59 in FIG. 5 and likewise in FIG. 6.

Figure 6:
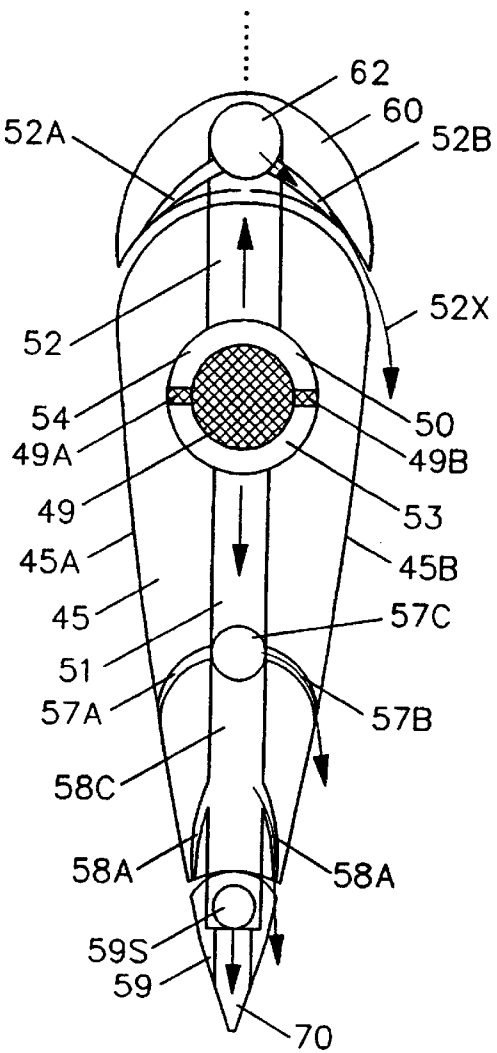
FIG. 6 shows the arrangement of FIG. 5 from above and in partial cross section.
Figure 7:
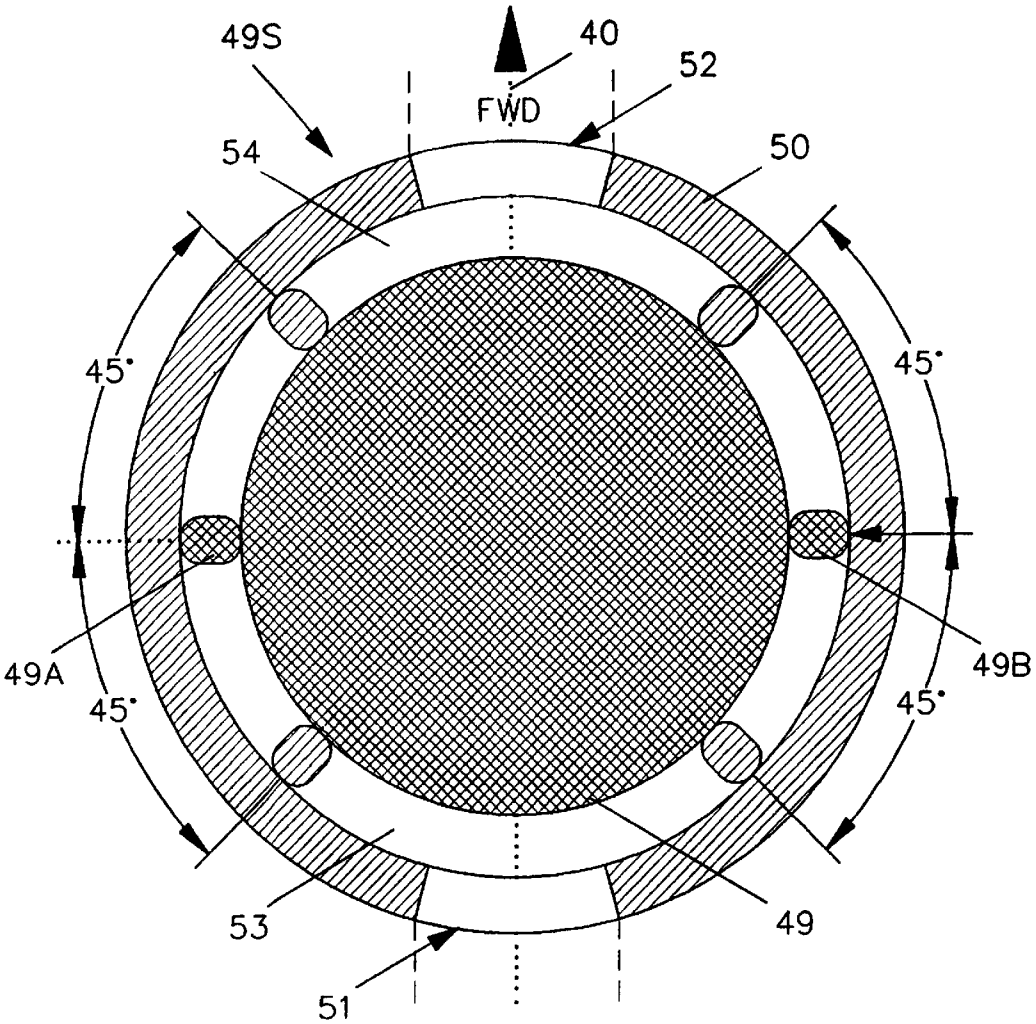
FIG. 7 shows an enlarged cross sectional view along the line VII—VII in FIG. 5.

In this embodiment there is not shown any distribution valve corresponding to valve 10 in FIGS. 1–4, but on the other hand there are shown at 63 and 64 two supply pipes for water from the ship's pump or pumps, whereby the distribution of water between supplies 63 and 64 takes place by suitable means in the ship itself. The two water flows are then led further downwards in two separate passageways in the form of annular spaces outside and surrounding the rudder stock 49. As will also appear from the cross sectional illustrations in FIGS. 6 and 7 the annular passageway around the rudder stock 49 is subdivided into two passages 53 and 54 by means of axially extending partitions 49A and 49B. Advantageously these can be attached to or formed as integrated parts of the actual rudder stock 49. At their radially outer edges, partitions 49A and 49B engage the inside of the surrounding cylindrical housing 50 and during turning movements of rudder 45 there will be maintained equally large flow cross sections in the two passages 53 and 54. As shown somewhat schematically in FIG. 5 there is incorporated a swivel device 49S between ship part 41 and rudder 45, so that flow passages 53 and 54 can extend without hindrance downwards within the rudder at turning movements thereof in relation to the ship. FIG. 7 in this connection illustrates possible angular deflections of the rudder, i.e. with 45° to either side in relation to the central position. Openings 51 and 52 out through housing 45 lead to respective ducts, being also denoted 51 and 52, respectively, in FIGS. 5 and 6. The preferred form of water supply being here explained with reference to FIGS. 5, 6 and 7, among other things involves the advantage that it is more simple than the design of FIGS. 1–4, since the distribution valve described therein, is not required.

Distribution duct 51 carries seawater to nozzle means 70 through a swivel 59S at the junction or hinge region between the main part 45 of the rudder and the rudder fin 59. Besides, in FIG. 5 there is shown a vertical distribution duct 57C branched off from duct 51 and provided with slots or nozzles 57A and 57B at either side of the rudder, for discharging partial flows of seawater to one or the other rudder side 45A or 45B. At the top of distribution duct 57C for this purpose there can be provided a valve (not shown) to serve for controlling these partial flows to the desired rudder side of surface. An additional form of such partial flows of water can also be directed out from nozzles 58A and 58B as shown in FIG. 6. The outlet opening from these nozzles or slots 58A and 58B can be located in a space between the leading edge of rudder fin 59 and the trailing edge of the actual rudder 45.

The additional water flows at the trailing portions of rudder 45 as just referred to, are normally considered to be of relatively subordinate significance compared to an additional flow as indicated with arrow 52X in connection with profile element 60 at the leading edge of the rudder. In contrast to profile element 20 in FIGS. 1–4, the interior of profile element 60 in the first place is provided with a vertical distribution duct 62 and in association therewith laterally directed ducts or slots 52A and 52B at either side. The water flow 52X being indicated in FIG. 6 thus can be obtained by outflow of seawater through distribution duct 52B. At the top of profile element 60 as schematically illustrated in FIG. 5, there is provided a swivel 62S for interconnecting ducts 52 and 62 with a possibility of a certain angular rotation of profile element 60 in relation to rudder 45 itself.

Figure 9:
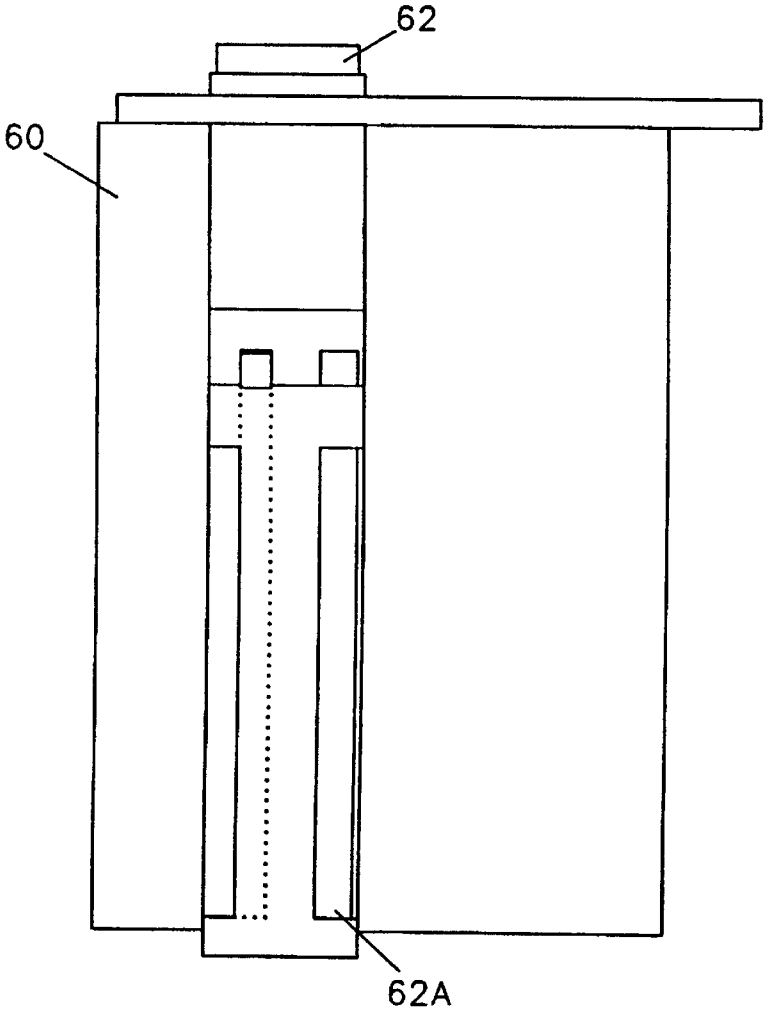
Figure 8:
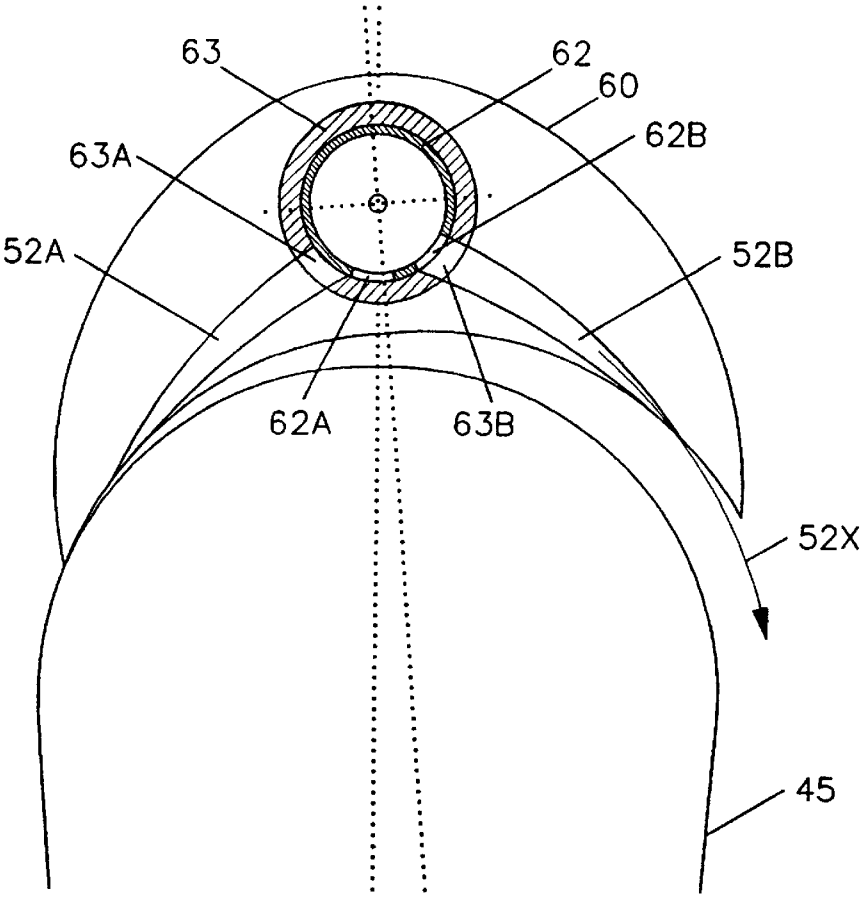
FIG. 8 shows an enlarged detail of the structure at the leading edge of the rudder in FIG. 6, FIG. 9 in schematic elevation shows the leading edge of the rudder in FIG. 8.

FIGS. 8 and 9 illustrate somewhat more in detail the structure for adjusting or controlling the water outflow to one or the other side from profile element 60. In FIG. 8 this is shown in an angular position where duct 52A is blocked, whereas duct 52B is active for discharging the additional flow 52X referred to above, along the adjacent surface of rudder 45. A control valve is provided in the form of tube elements 62 and 63 surrounding the vertical pivot axis for element 60. The inner tube element 62, surrounding the above vertical distribution duct, has two longitudinal, vertical slot openings 62A and 62B that can have a mutual angular displacement of about 90°. The exterior tube element 63 has corresponding longitudinal Slot openings 63A and 63B with a somewhat larger mutual angular displacement than between openings 62A and 62B. Tube 63 is securely anchored within profile element 60 and will rotate together with that element. Tube 62 however, is stationary in relation to rudder 45. Accordingly an angular movement of profile element 60 will have influence on the water outflow from the duct within tube 62 out through the respective more or less coinciding slots and thereby to one or the other of outflow ducts 52A and 52B.

In accordance with the explanation above the inner tube element 52 can be connected to a projecting upper part of rudder 45, as will be seen from FIG. 5, and can rest on a swivel at the lower end. The outer tube element 63 can be considered to constitute a rudder stock for profile element 60 and in addition to be incorporated as a component in the control valve described, with bearing points at the upper and the lower ends respectively, where a swivel can be provided.

Figure 10:
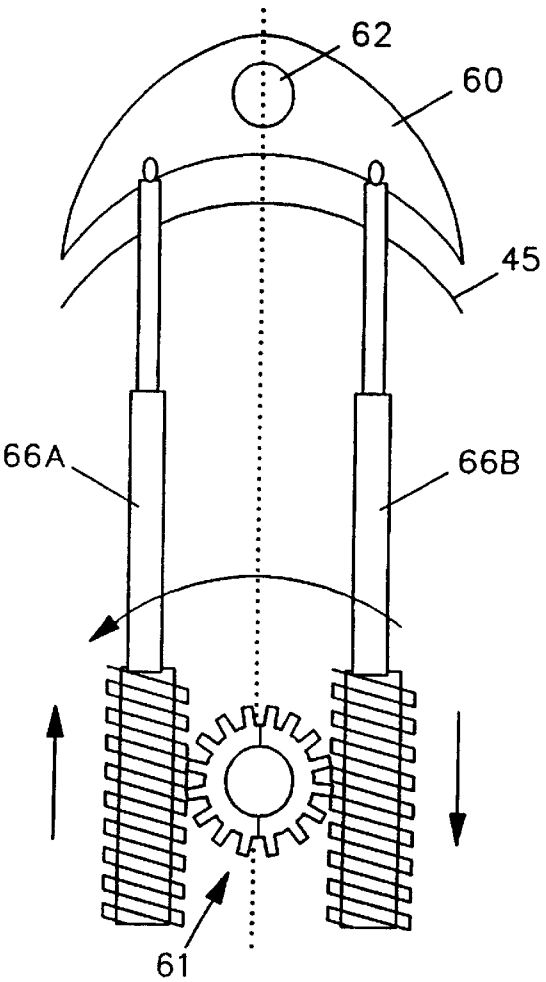
FIG. 10 shows a specific embodiment of a turning mechanism for adjusting a leading edge element of a rudder, e.g. corresponding to the embodiment of FIGS. 6 and 8.

Whereas FIGS. 5–9 have not comprised any turning mechanism for the angular movement of profile element 60, FIG. 10 in a simplified and schematic manner illustrates a design for that purpose. The turning mechanism of FIG. 10 is rotationally driven by drive means generally denoted 61 associated with the actual rudder stock, such as by a thread or worm gear transmission to two manoeuvre rods 66A and 66B which e.g. in the form of telescopical extension and articulation to profile element 60 at their outer ends, can provide for the desired angular setting of the profile element about the axis or duct 62.

The embodiments described above make possible relatively simple designs of the rudder parts, in particular when considered in relation to the advanced functions being obtained. The embodiments of FIGS. 5–9 also lead to a reduced flow resistance for the seawater supply to the various auxiliary means serving to enhance the steering effect of the rudder. It will be possible to manufacture the profile element and the rear fin of the rudder as separate units and likewise the swivel-sleeve arrangement around the rudder stock in FIGS. 5, 6 and 7 can be assembled as a separate unit for mounting around the rudder stock through the adjacent hull part. Such embodiments can have much commercial significance also because it can be possible to convert conventional rudders to more sophisticated rudders with an enhanced steering effect, as provided for by this invention.

It will be realized that the embodiments here described with reference to the drawings, are shown and explained in part in a relatively simplified and schematic form, for the purpose of primarily to explain the principles according to the invention. At many points in the designs described it will be possible to make modifications and add structural elements while maintaining the basic solutions being presented by the invention.

What is claimed is:

1. An apparatus for enhancing the steering effect of ship rudders comprising;

rudder with at least one passageway for supplying seawater to ducts in the rudder, and a profile element extending substantially vertically at a leading edge of the rudder and being pivotable about a generally vertical axis, wherein distribution ducts formed between the profile element and the rudder communicate with said passageway and are adjustable so that relative movement of the profile element and the rudder causes seawater to be discharged along the rudder surface facing abaft.

2. An apparatus according to claim 1, further comprising a turning mechanism associated with a rudder stock, wherein the profile element is angularly adjustable about said vertical axis by said turning mechanism, said turning mechanism comprising at least one manoeuvre rod one end of which is directly or indirectly articulated to the profile element.

3. An apparatus according to claim 2, wherein the profile element comprises internal connection ducts which form a central duct that leads out to either side of the profile element for discharging seawater adjacent to outer portions of the profile element and distributes seawater to either one or the other side depending upon an angular position of the profile element with respect to said vertical axis.

4. An apparatus according to claim 3, further comprising a control valve for controlling distribution of seawater to either one or the other side of the profile element, said control valve comprising first and second tubular elements, said tubular elements being concentric about said vertical axis, said first element being rotationally connected to the rudder, said second element being rotationally connected to the profile element, and both elements having respective pairs of cooperating, axially extending slot openings forming substantially open and substantially closed flow openings depending upon the angular position of the profile element, whereby each of the slot openings in the second tubular element communicates with a separate one of the distribution ducts.

5. An apparatus according to claim 1, wherein the profile element comprises internal connection ducts which form a central duct that leads out to either side of the profile element for discharging seawater adjacent to outer portions of the profile element and distributes seawater to either one or the other side depending upon an angular position of the profile element with respect to said vertical axis.

6. An apparatus according to claim 5, further comprising a control valve for controlling distribution of seawater to either one or the other side of the profile element, said control valve comprising first and second tubular elements, said tubular elements being concentric about said vertical axis, said first element being rotationally connected to the rudder, said second element being rotationally connected to the profile element, and both elements having respective pairs of cooperating, axially extending slot openings forming substantially open and substantially closed flow openings depending upon the angular position of the profile element, whereby each of the slot openings in the second tubular element communicates with a separate one of the distribution ducts.

7. An apparatus according to any one of claims 1, wherein a space between the leading edge of the rudder and the inside of the profile element constitutes said distribution ducts.

8. An apparatus according to claim 1, further comprising:

a nozzle with an adjustable angle provided at a trailing edge of the rudder and adapted to discharge seawater supplied through an associated duct, through the rudder.

9. An apparatus according to claim 8, wherein the nozzle is incorporated in a rear, pivotable rudder fin.

10. An apparatus according to claim 9, wherein said passageway extends in part internally in a rudder stock and a distribution valve for supplying water to the profile element and the nozzle, is arranged axially in the extension of the rudder stock.

11. An apparatus according to claim 10, wherein the distribution valve comprises a rotatable valve body which depending upon its rotational position is adapted to substantially block at least one of two valve openings that communicate with a duct to the nozzle on one hand, and the distribution ducts of the profile element on the other hand.

12. An apparatus according to claim 8, wherein said passageway extends in part internally in a rudder stock and a distribution valve for supplying water to the profile element and the nozzle, is arranged axially in the extension of the rudder stock.

13. An apparatus according to claim 12, wherein the distribution valve comprises a rotatable valve body which depending upon its rotational position is adapted to substantially block at least one of two valve openings that communicate with a duct to the nozzle on one hand, and the distribution ducts of the profile element on the other hand.

14. An apparatus according to claim 1, wherein said passageway has in part the form of an annular space surrounding a rudder stock and a swivel device is provided for a rotational connection between a ship hull and the rudder.

15. An apparatus according to claim 14, wherein the annular space is subdivided into two passages of which one communicates with a duct leading to the nozzle device and the other communicates with a duct leading to the profile element.

16. An apparatus according to claim 2, wherein a space between the leading edge of the rudder and the inside of the profile element constitutes said distribution ducts.

17. An apparatus according to claim 2, further comprising:

a nozzle with an adjustable angle provided at a trailing edge of the rudder and adapted to discharge seawater supplied through an associated duct, through the rudder.

18. An apparatus according to claim 17, wherein the nozzle is incorporated in a rear, pivotable rudder fin.

19. An apparatus according to claim 2, wherein said passageway has in part the form of an annular space surrounding a rudder stock and a swivel device is provided for a rotational connection between a ship hull and the rudder.

20. An apparatus according to claim 19, wherein the annular space is subdivided into two passages of which one communicates with a duct leading to the nozzle and the other communicates with a duct leading to the profile element.

21. A method for enhancing steering effect of a ship rudder, comprising the steps of:

supplying seawater to a rudder duct;

pivoting a profile element relative to said rudder duct to thereby direct said seawater along a surface of said rudder.

22. The method according to claim 21, further comprising the steps of:

directing seawater from said rudder duct to a nozzle provided at a trailing edge of said rudder; and discharging seawater through said nozzle, said nozzle having an adjustable angle.

* * * * *